US009843125B2

(12) United States Patent
Tan et al.

(10) Patent No.: US 9,843,125 B2
(45) Date of Patent: Dec. 12, 2017

(54) MULTIFUNCTION CONNECTOR

(71) Applicant: 3M INNOVATIVE PROPERTIES COMPANY, St. Paul, MN (US)

(72) Inventors: Vincent Tan, Singapore (SG); Kok Hoe Lee, Singapore (SG); Rao L. Vittapalli, Singapore (SG); YunLong Qiao, Singapore (SG); Saujit Bandhu, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/906,995

(22) PCT Filed: Jul. 21, 2014

(86) PCT No.: PCT/US2014/047354

§ 371 (c)(1),
(2) Date: Jan. 22, 2016

(87) PCT Pub. No.: WO2015/017150

PCT Pub. Date: Feb. 5, 2015

(65) Prior Publication Data

US 2016/0164216 A1 Jun. 9, 2016

Related U.S. Application Data

(60) Provisional application No. 61/861,059, filed on Aug. 1, 2013.

(51) Int. Cl.
*H01R 13/514* (2006.01)
*H01R 27/02* (2006.01)
(Continued)

(52) U.S. Cl.
CPC ..... *H01R 13/514* (2013.01); *H01R 12/71* (2013.01); *H01R 12/72* (2013.01); *H01R 27/02* (2013.01); *H01R 2107/00* (2013.01)

(58) Field of Classification Search
CPC ..... H01R 13/514; H01R 27/02; H01R 12/72; H01R 12/71; H01R 2107/00
(Continued)

(56) References Cited

U.S. PATENT DOCUMENTS 6,238,244 B1 * 5/2001 Yang ..... H01R 23/6873 439/541.5
6,736,651 B2 * 5/2004 Ho ..... H01R 12/725 439/540.1
(Continued)

FOREIGN PATENT DOCUMENTS

CN 201285874 Y 8/2009
CN 102684020 A 9/2012
(Continued)

OTHER PUBLICATIONS

International Search Report for PCT International Application No. PCT/US2014/047354, dated Oct. 7, 2014, 3 pages.

*Primary Examiner* — Harshad Patel
(74) *Attorney, Agent, or Firm* — Robert S. Moshrefzadeh

(57) ABSTRACT

An electrical connector includes a unitary base elongated along a longitudinal direction. A first tongue extends forwardly from the base and has a uniform thickness along the longitudinal direction. The first tongue comprises a plurality of spaced apart first contacts. A second tongue extends forwardly from the base and comprises a plurality of spaced apart second contacts. The first and second tongues define a gap therebetween that extends from a front edge of one of the first and second tongues toward the unitary base.

2 Claims, 15 Drawing Sheets

(51) Int. Cl.
*H01R 12/71* (2011.01)
*H01R 12/72* (2011.01)
*H01R 107/00* (2006.01)

(58) Field of Classification Search
USPC ..... 439/630, 631, 541.5, 79, 660
See application file for complete search history.

(56) References Cited

U.S. PATENT DOCUMENTS 6,832,934 B1 12/2004 Zhang
7,270,570 B1 * 9/2007 Hamner ..... H01R 13/65802 439/541.5
7,311,556 B2 * 12/2007 Wan ..... H01R 12/722 439/607.32
7,946,887 B1 * 5/2011 Zhang ..... H01R 27/02 439/607.23
7,976,316 B2 7/2011 Ohshida
7,997,927 B2 * 8/2011 Wan ..... H01R 12/724 439/541.5
8,011,959 B1 * 9/2011 Tsai ..... H01R 13/6275 439/541.5
8,011,960 B2 * 9/2011 Xiao ..... H01R 27/02 439/607.24
9,362,682 B2 * 6/2016 Chien ..... H01R 13/6581
2004/0123458 A1 7/2004 Korsunsky
2009/0318026 A1 * 12/2009 Yi ..... H01R 13/6658 439/607.24
2010/0075538 A1 3/2010 Ohshida
2012/0077385 A1 * 3/2012 Qiao ..... H01R 27/02 439/628

FOREIGN PATENT DOCUMENTS

TW M312100 U 5/2007
WO WO 2010-141307 12/2010
WO WO 2011-130465 10/2011

* cited by examiner

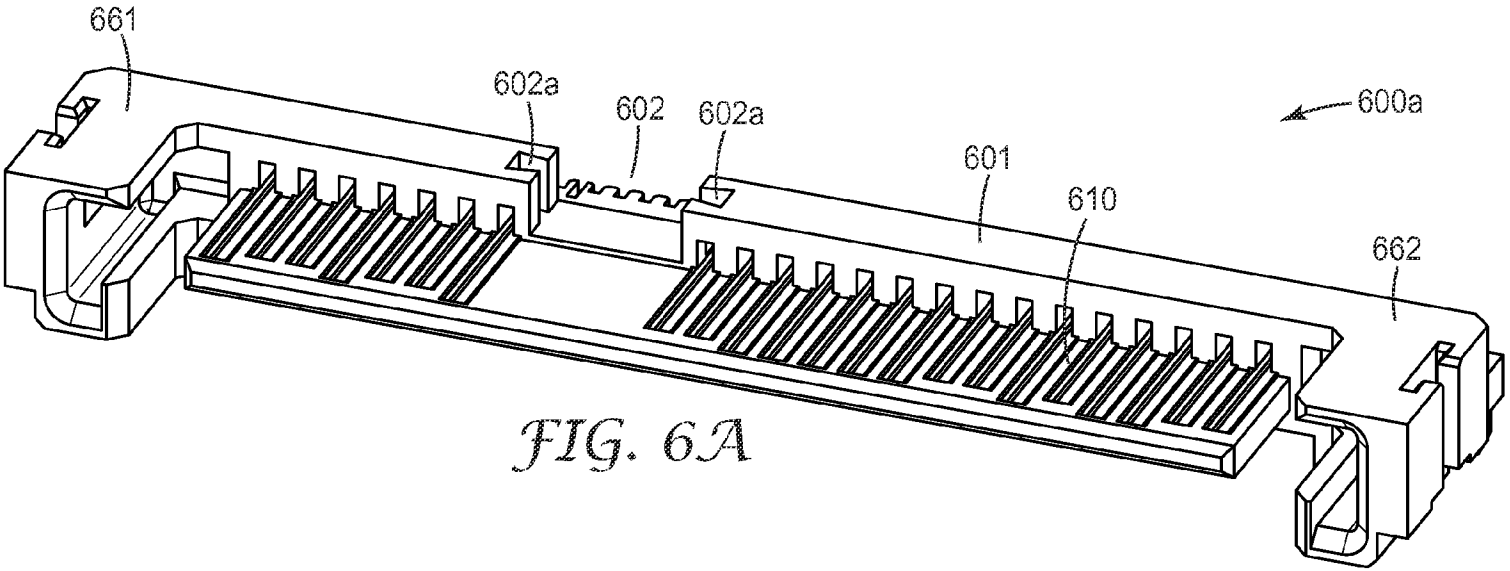
FIG. 6A
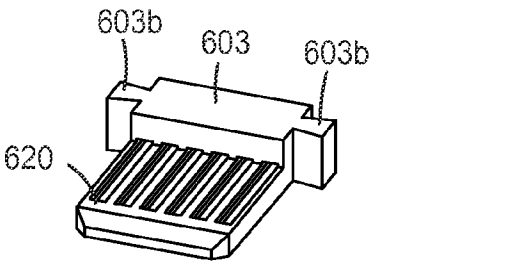
FIG. 6B
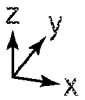

MULTIFUNCTION CONNECTOR

TECHNICAL FIELD

This disclosure relates generally to connectors suitable for data transmission between various devices including computer peripherals.

BACKGROUND

Electrical cables facilitate transmission of electrical signals between devices. Cable connectors can be designed to provide interconnection between devices having a particular type of communications protocol, such as serially attached small computer interface system (SAS) and peripheral component interconnect express (PCIe). In view of the need for high speed interconnection between computers and peripheral devices, a continuing need exists for electrical cables that are capable of transmitting high speed signals, are mechanically robust, cost-effective, and can be used in a variety of applications.

BRIEF SUMMARY

Some embodiments involve an elongated electrical connector for mounting on a printed circuit board and mating with a mating connector along a mating direction. The connector includes an elongated base extending along a longitudinal direction perpendicular to the mating direction. First and second end walls extend forwardly along the mating direction from opposite longitudinal ends of the base. A bottom tongue extends forwardly along the mating direction from the base and disposed between and spaced apart from the first and second end walls. The bottom tongue has a uniform thickness along its length along the longitudinal direction and comprising first and second bottom tongue portions separated by a third bottom tongue portion. A top tongue extends forwardly along the mating direction from the base and disposed between and spaced apart from the first and second end walls. The top tongue has a uniform thickness along its length along the longitudinal direction and is spaced apart from the bottom tongue along a thickness direction perpendicular to the mating and longitudinal directions. A bottom surface of the top tongue faces a top face of the third bottom tongue portion. A plurality of spaced apart first contacts is disposed on a top surface of the first bottom tongue portion. A plurality of spaced apart second contacts is disposed on a top surface of the second bottom tongue portion. A plurality of spaced apart third contacts is disposed on a bottom surface of the bottom tongue. A plurality of spaced apart fourth contacts is disposed on a top surface of the top tongue.

Another embodiment is directed to an electrical connector. The electrical connector includes a unitary base elongated along a longitudinal direction. A first tongue extends forwardly from the base and has a uniform thickness along the longitudinal direction. The first tongue comprises a plurality of spaced apart first contacts. A second tongue extends forwardly from the base and comprises a plurality of spaced apart second contacts. The first and second tongues define a gap therebetween that extends from a front edge of one of the first and second tongues toward the unitary base.

Yet another embodiment involves an electrical (socket) connector. The connector includes a unitary housing elongated along a longitudinal direction perpendicular to a mating direction of the connector. The unitary housing defines a central slot extending along the longitudinal direction. The central slot includes first and second slot portions separated by a third slot portion. Each slot portion comprises opposing top and bottom surfaces and a separation between the top of bottom surfaces of each slot portion along a thickness direction orthogonal to the longitudinal and mating directions defines a height of the slot. The first and second slot portions have a same smaller height and the third slot portion has a greater height. The unitary housing includes a blade extending forwardly along the mating direction from a back surface of the third slot portion. The blade is disposed between and spaced apart from the top and bottom surfaces of the third slot portion. A plurality of spaced apart first contacts is disposed on a top surface of the first slot portion. A plurality of spaced apart second contacts is disposed on a top surface of the second slot portion. A plurality of spaced apart third contacts is disposed on bottom surfaces of the first, second and third slot portions. A plurality of spaced apart fourth contacts is disposed on a top surface of the third slot portion.

In some embodiments, an electrical connector includes a unitary insulative housing defining an elongated slot bound by opposing first and second major surfaces. The housing includes a blade extending from a back surface of the slot toward a front of the slot and disposed between and spaced apart from the first and second major surfaces. A first plurality of contacts is disposed on the first major surface and facing the blade. A second plurality of contacts is disposed on the second major surface and facing the blade.

Yet other embodiments involve an electrical connector adapted to mate with a mating connector that includes overlapping planar top and bottom tongues defining a gap therebetween. Each tongue carries a plurality of contacts. The electrical connector includes an insulative planar blade, such that when the electrical connector mates with the mating connector, the insulative planar blade is inserted in the gap to provide support to at least one of the top and bottom tongues.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

FIGS. 6A-6D are perspective views of a multi-piece connector in accordance with some embodiments;

In the figures, like reference numerals designate like elements.

DESCRIPTION OF ILLUSTRATIVE EMBODIMENTS

Embodiments disclosed herein involve connectors that are suitable for providing data transmission between devices such as computer peripherals. The connectors disclosed herein include mating multi-contact connectors that can be terminated to a printed circuit board or cable.

Figure 1A:
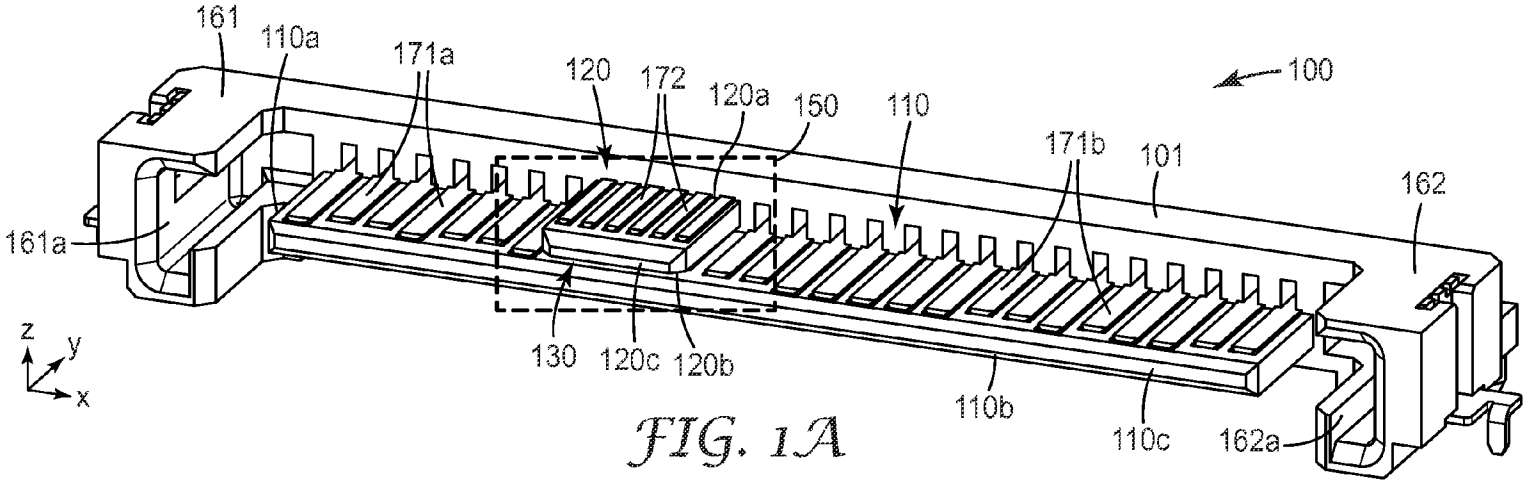
FIG. 1A shows a perspective view of a connector in accordance with some embodiments.
Figure 1B:
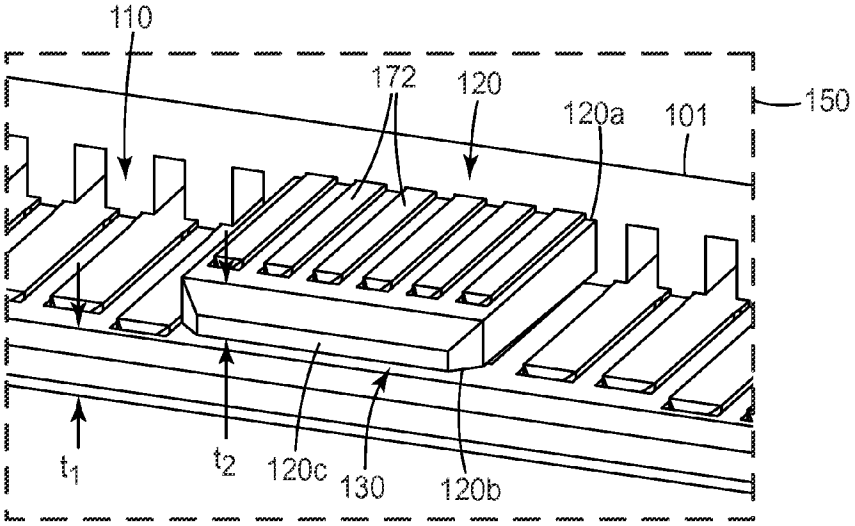
FIG. 1B shows a close-up perspective view of a portion of the connector of FIG. 1A.
Figure 1C:
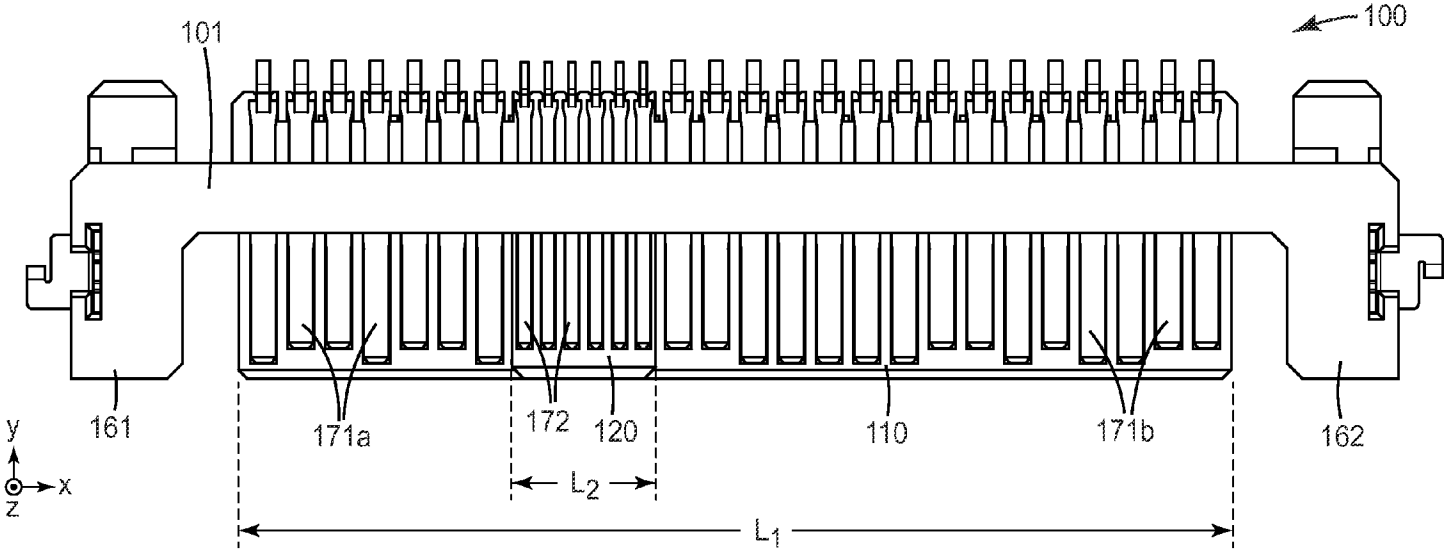
FIG. 1C shows a top view of the connector of FIG. 1A.
Figure 1D:
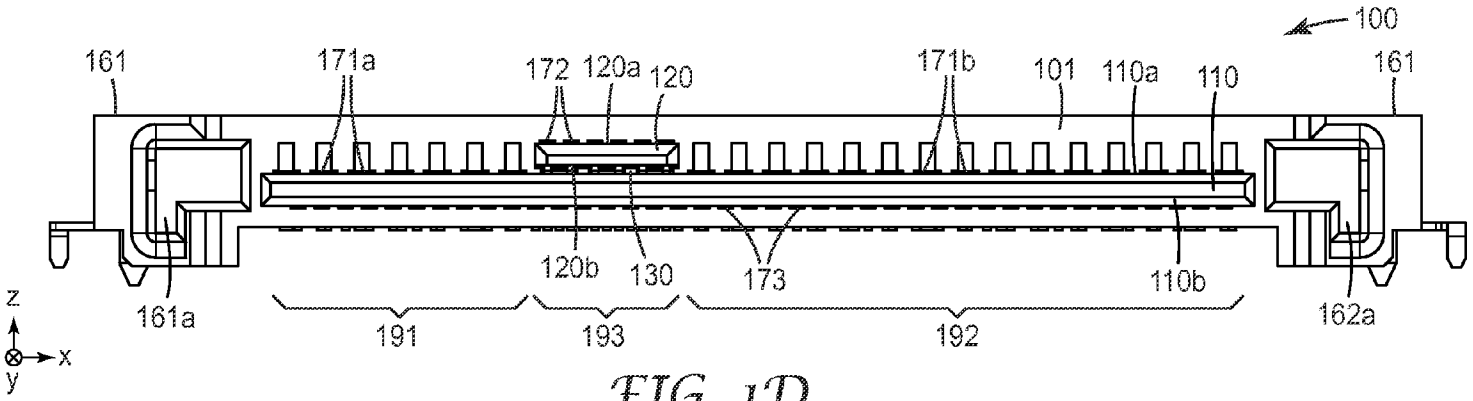
FIG. 1D shows a front view of the connector of FIG. 1A.

FIG. 1A shows a perspective view, FIG. 1C shows a top view, and FIG. 1D shows a front view of a connector 100 in accordance with some embodiments. FIG. 1B shows a close up perspective view of a portion 150 of connector 100. Connector 100 is also referred to herein as a "plug" or "plug connector." The connector 100 includes a base 101 that is elongated along a longitudinal direction (the x-direction as indicated in FIG. 1A) that is perpendicular to a mating direction (the y-direction as indicated in FIG. 1A). End walls 161, 162 extend forwardly along the mating axis from opposite longitudinal ends of the base 101. In some embodiments, the base 101 is formed as a unitary, one-piece construction. In some embodiments the base 101 and the end walls 161, 162 are formed as a unitary, one-piece construction.

The connector 100 includes a first tongue 110 and a second tongue 120. Each of the first and second tongues 110, 120 extends from the base 101 forwardly along the mating axis. In some embodiments, the base 101, the first and second tongues 110, 120, and the first and second end walls 161, 162 form a unitary construction. Unitary constructions are one-piece constructions that may be formed of a polymeric material, plastic or any insulating material by molding, machining, and/or extruding, for example.

The first tongue 110 is disposed between the end walls 161, 162 and in some embodiments the first tongue 110 is spaced apart from the end walls 161, 162. The first tongue 110 has a first surface 110*a* and a second surface 110*b*, and may have a plurality of electrical contacts 171*a*, 171*b* spaced apart and disposed on the first surface 110*a*. The first tongue 110 may have a plurality of electrical contacts 173 disposed on the second surface 110*b*.

The connector 100 includes a second tongue 120 that extends from the base 101 forwardly along the mating axis. The second tongue 120 is disposed between the first and second end walls 161, 162 and may be spaced apart from the end walls 161, 162. The second tongue 120 has a first surface 120*a* and a second surface 120*b*. A plurality of electrical contacts 172 may be spaced apart and disposed on the first surface 120*a*. The first surface 110*a* of the first tongue 110 and the second surface 120*b* of the second tongue 120 are separated by a gap 130. In the orientation illustrated in FIG. 1D, the first tongue 110 is oriented below the second tongue 120. Thus, the first tongue 110 may be referred to herein as the "bottom tongue" and the second tongue 120 may be referred to as the "top tongue," although the reader will understand that the terms "top" and "bottom" are merely used for identification of the first and second tongues 110, 120 and not meant to limit the embodiments to any particular connector orientation.

Electrical contacts may be disposed on the second surface 120*b* of the second tongue 120 if the separation distance between the first surface 110*a* of the first tongue 110 and the second surface 120*b* of the second tongue 120 is sufficient to support electrical contacts on both surfaces 110*a*, 120*b*. However, in many cases, as shown in FIGS. 1A-1D, there are no electrical contacts on the second surface 120*b* of the second tongue 120 and there are also no electrical contacts on the first surface 110*a* of the first tongue 110 in the region of the gap 130 where the second tongue 120 overlaps the first tongue 110.

FIG. 1B is a close-up view of the portion 150 of connector 100 that shows the region of the gap 130 where the second tongue 120 overlaps the first tongue 110.

As best seen in FIG. 1C, the first tongue 110 has a length, $L_1$, extending along the longitudinal direction (x-direction) of the connector 100 and the second tongue 120 has a length, $L_2$, extending along the longitudinal direction. In general, the lengths $L_1$ and $L_2$ may be related to the number of electrical contacts needed for the connector, and may be any lengths suitable for the connector 100. In some embodiments, the top surface of the first tongue carries about 22 contacts, the bottom surface of the first tongue carries about 40 contacts and the top surface of the second tongue carries about 6 contacts, although the number of contacts can vary according to the implementation for which the connector is used. Lengths $L_1$ and $L_2$ may be equal to each other, $L_1=L_2$, or may be different from each other, e.g., $L_2<L_1$. For example, $L_1$ may be several times larger than $L_2$, e.g., $L_1$ may be about 30 mm to 37 mm and $L_2$ may be about 7 mm to 12 mm.

In some embodiments, the first tongue 110 has uniform thickness along the longitudinal x-direction and the mating y-direction. For example, the first tongue 110 can have a thickness of about 0.7 mm to 1.70 mm, or about 1.0 mm to 2.35 mm. In some embodiments, the first tongue has a uniform thickness along the longitudinal direction (x-direction) and the mating direction (y-direction). For example, the second tongue 120 can have a thickness of about 0.5 mm to 3.0 mm, or about 1.2 mm to 5.5 mm.

The thicknesses, $t_1$, $t_2$, of the first and second tongues 110, 120 can be equal to each other, $t_1=t_2$, or they can be different from each other, $t_1>t_2$, or $t_1<t_2$. In some embodiments, the first tongue 110 is uniformly thicker than the second tongue 120 along the longitudinal axis (x-axis in FIG. 1A). In some embodiments, the first tongue 110 is uniformly thinner than the second tongue 120 along one or more of the longitudinal axis (x-axis in FIG. 1A). The first and/or second tongues 110, 120 may have an edge 110*c*, 120*c* that is beveled, rounded, chamfered, or blunt.

The thickness, $t_1$, of the first tongue 110 may or may not be uniform along the mating axis. For example, the thickness, $t_1$, of the first tongue 110 may taper (increase or decrease) from a first thickness, $t_{1b}$, at the base 101 to a second thickness, $t_{1e}$, at the edge 110*c*. The first thickness, $t_{1b}$, may be greater than $t_{1e}$, $t_{1b}>t_{1e}$, or $t_{1b}$ may be less than $t_{1e}$, $t_{1b}<t_{1e}$. The thickness, $t_2$, of the second tongue 120 may or may not be uniform along the mating axis. For example, the thickness, $t_2$, of the second tongue 120 may taper from a first thickness, $t_{2b}$, at the base 101 to a second thickness, $t_{2e}$, at the edge 120*c*. The first thickness, $t_{2b}$, may be greater than $t_{2e}$, $t_{2b}>t_{2e}$, or $t_{2b}$ may be less than $t_{2e}$, $t_{2b}<t_{2e}$. The thicknesses of the first and/or second tongues may increase or decrease linearly, non-linearly, or piece-wise linearly, for example.

In some embodiments, the connector 100 includes end walls 161, 162 disposed at one or both ends of the base 101 and extending from the base 101 forwardly along the mating direction. The end walls 161, 162 may comprise optional channels 161*a* 162*a*. The channels 161*a*, 162*a*, shown as U-shaped in FIGS. 1A, 1C, and 1D, can be any convenient shape and are configured to slidably engage with compatible protrusions of a mating connector (not shown in FIG. 1A).

As best seen in FIG. 1D, the first tongue 110 can comprise a first portion 191 and a second portion 192 separated by a third portion 193. The connector 100 includes a plurality of spaced apart first electrical contacts 171*a* disposed on the first surface 110*a* of the first tongue 110 in the first portion 191; a plurality of spaced apart second electrical contacts 171*b* disposed on the first surface 110*a* of the first tongue 110 in the second portion 192, and a plurality of third electrical contacts 173 disposed on the second surface 110*b* of the first tongue 110 in the first, second, and/or third portions 191, 192, 193.

The connector 100 includes a second tongue 120 that includes plurality of spaced apart electrical contacts 172 disposed on the first surface 120*a* of the second tongue 120. In some embodiments, there are no electrical contacts on the first surface 110*a* of the first tongue 110 in the third portion 193. In some embodiments, there are no electrical contacts disposed on the second surface 120*b* of the second tongue 120.

Figure 2A:
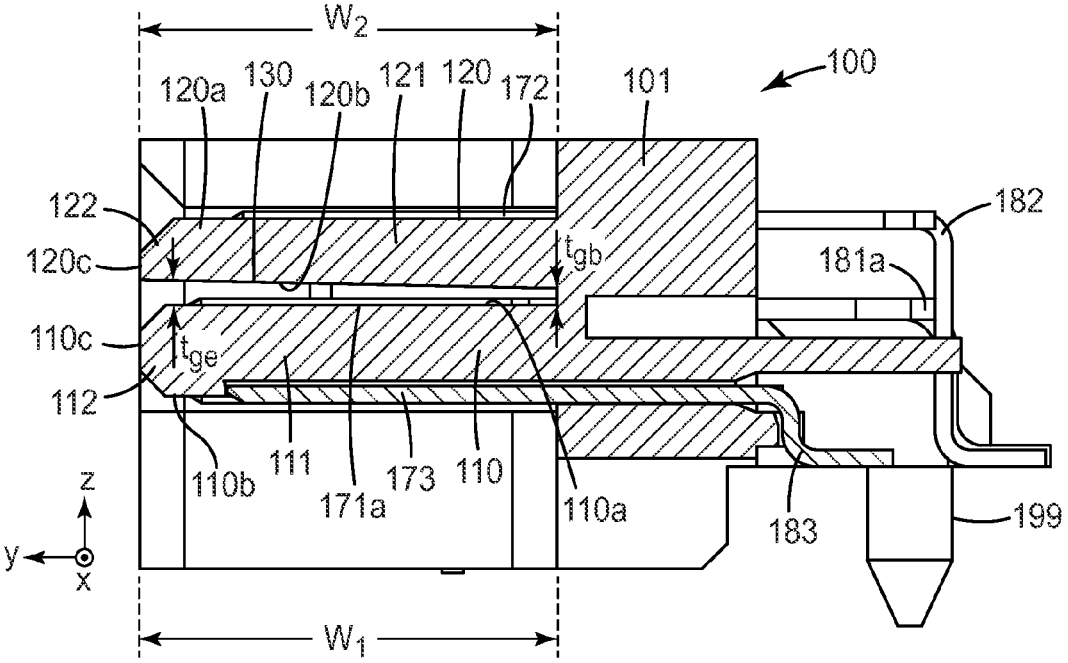
FIG. 2A depicts a side-cross-sectional view of the connector of FIG. 1A taken through the first and second tongues.

FIG. 2A depicts a side cross sectional view of the connector 100 taken through the first and second tongues 110, 120. The first tongue 110 extends forwardly from the base 101 and has a width, $W_1$, extending from the base 101 to the edge 110*c*. The second tongue 120 extends forwardly from the base 101 and has a width, $W_2$, extending from the base 101 to the edge 120*c*. In some embodiments, as shown in FIG. 2A, $W_1=W_2$. However, in other embodiments, $W_1$ may be greater or less than $W_2$. In some implementations, and with reference to FIG. 1D, the widths of the first tongue 110 in first portion 191, second portion 192, and third portion 193 may not be equal. For example, in some configurations the width of the third portion 193 is smaller than the widths of the first and/or second portions 191, 192.

As depicted in FIG. 2A, the first tongue 110 can include a first major region 111 at or nearest to the base 101 and a beveled region 112 near the edge 110*c* where one or both surfaces 110*a*, 110*b* are beveled. The second tongue 120 can include a first major region 121 at or nearest to the base 101 and beveled region 122 at the edge 120*c* where one or both surfaces 120*a*, 120*b* are beveled. In the implementation depicted in FIG. 2A, both surfaces 110*a*, 110*b* of the first tongue 110 are beveled, the first surface 120*a* of the second tongue is beveled, and the second surface 120*b* of the second tongue 120 is not beveled.

FIG. 2A shows the gap 130 between the tongues 110, 120 and other structures of connector 100 in accordance with some embodiments. The gap 130 is formed between the first surface 110*a* of the first tongue 110 and the second surface 120*b* of the second tongue 120. In many embodiments, the first surfaces 110*a*, 120*a* and second surfaces 110*b*, 120*b* are substantially planar. The gap 130 has a thickness, $t_g$, along the z axis that may be uniform, or may vary along the mating y or longitudinal x-axes. In some embodiments, $t_g$ is in a range of about 0.1 mm to about 5 mm, or about 0.1 mm to about 2 mm, or about 0.1 to about 1 mm. In some cases, $t_g$ is uniform with respect to the mating y and longitudinal x-axes.

In some cases, $t_g$ may vary with respect to the y and/or x axes. FIG. 2 indicates the thickness, $t_{gb}$, of the gap 130 at or nearest to the base 101 of the connector 100. FIG. 2A indicates the thickness, $t_{ge}$, of the gap 130 near an edge 110*c*, 120*c* of the first or second tongues 110, 120 taken between an unbeveled region of the first surface 110*a* and unbeveled region of the second surface 120*b*. In various implementations, $t_{gb}$ may be equal to $t_{ge}$, and the thickness of the gap along the mating axis is uniform. Alternatively, the thickness of the gap 130 may be tapered toward the base along the mating axis, wherein $t_{ge}>t_{gb}$ and the gap 130 linearly decreases along the mating axis from $t_{ge}$ to $t_{gb}$. Alternatively, the gap 130 may be tapered toward the edge, wherein $t_{gb}>t_{ge}$ and the gap 130 linearly decreases along the mating axis from $t_{gb}$ to $t_{ge}$.

The cross-sectional view of FIG. 2A shows electrical contacts 171*a* disposed on the first surface 110*a* of the first tongue 110, electrical contacts 173 disposed on the second surface 110*b* of the first tongue 110, and electrical contacts 172 disposed on the first surface 120*a* of the second tongue 120. In many embodiments, such as the one depicted in FIG. 2A, the second tongue 120 does not include electrical contacts on its second surface 120*b* and the first tongue 110 does not include electrical contacts on its first surface 110*a* in the region of the gap 130.

As shown in FIG. 2A, the electrical contacts 171*a*, 173, 172 have leads 181*a*, 183, 182, respectively, extending backwardly along the mating axis beyond the base 101. In this particular embodiment, leads 181*a*, 183, 182 are configured for surface mounting on a printed circuit board. In other embodiments, the leads may be configured for through-hole mounting.

The connector 100 shown in FIG. 2A and some other connectors shown herein are the right-angle mount connectors. It will be appreciated that approaches disclosed herein are also applicable to connectors that are configured to mount vertically on a printed circuit board. FIG. 2A depicts an alignment peg 199 oriented for right angle mounting and configured to align the connector on the printed circuit board. Alignment pegs may also be used in vertical mount embodiments. In embodiments that involve stacked connectors, alignment pegs may be used to align adjacent stacked connectors.

Figure 2B:
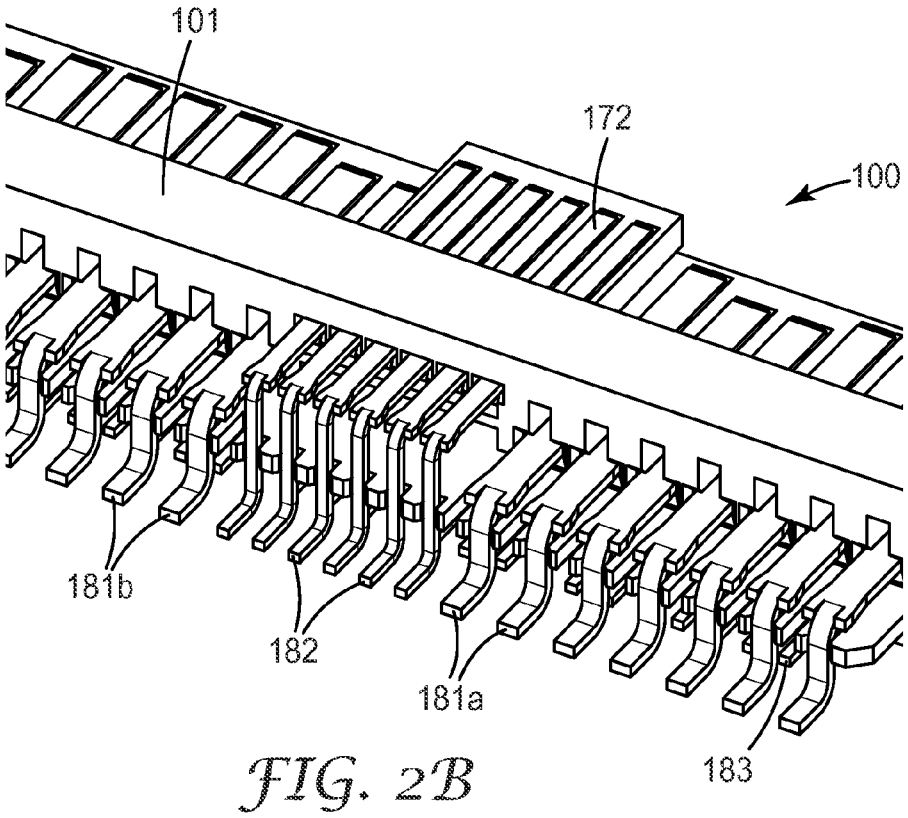
FIG. 2B provides a back view of a portion of the connector of FIG. 1A.

FIG. 2B provides a back perspective view of a portion of connector 100, showing the base 101, electrical contacts 172, and electrical leads 181*a*, 181*b*, 182, and 183.

Figure 3A:
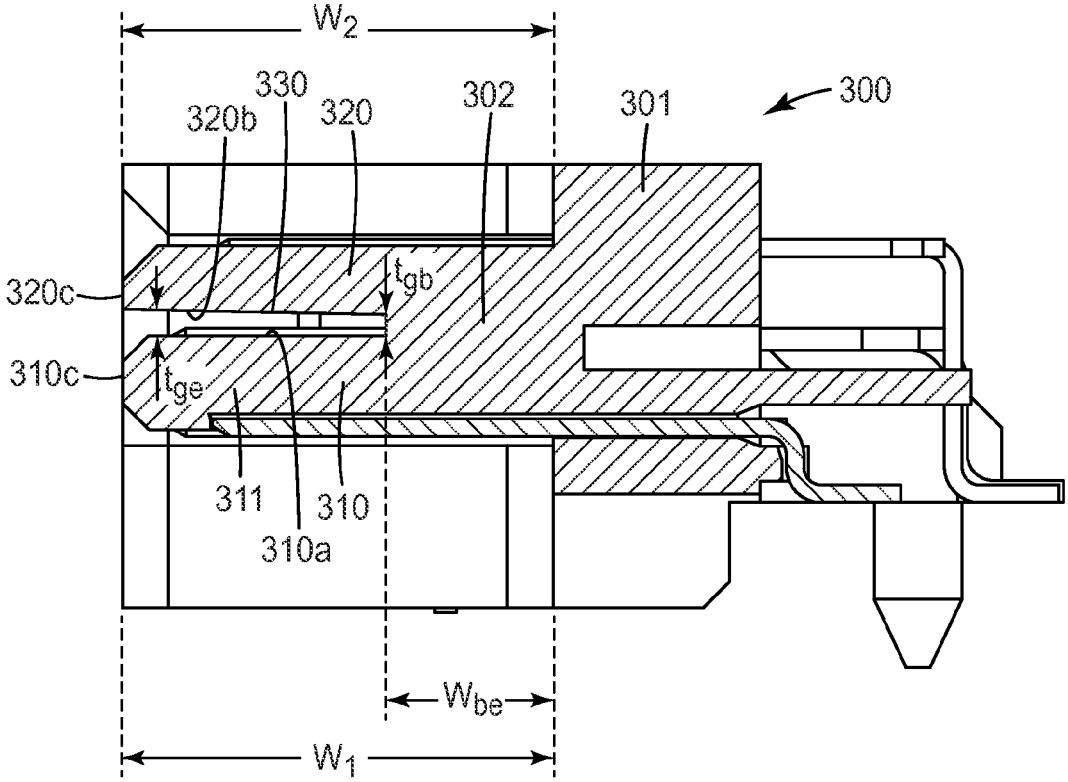
FIG. 3A illustrates a side cross-sectional view of a connector that includes a base extension in the region of the gap.

FIG. 3A illustrates a connector 300 that includes some features similar to those of connector 100. Additionally, connector 300 includes a base extension 302 in the region of the gap 330. The base extension 302 extends forwardly from the base 301 along the mating y-axis. In many embodiments, the base extension 302 has a width, $W_{be}$, that is less than the width, $W_1$, of the first tongue 310, and/or less than the width, $W_2$, of the second tongue 320. For example, the width, $W_{be}$, of the base extension 302 may be about 50% or less than the width, $W_1$, of the first tongue 310 and/or may be about 50% or less than the width, $W_2$, of the second tongue 320. The base extension 302 can be configured to provide additional structural support to the first and/or second tongues 310, 320.

The gap 330 has a thickness, $t_g$, that, in some embodiments, may be uniform along the longitudinal x-axis and/or may be uniform along the mating y-axis. In some embodiments, the gap may taper along the mating y-axis. FIG. 3A indicates the thickness, $t_{gbe}$, of the gap 330 at or nearest to the base extension 302 and the thickness of the gap, $t_{ge}$, located near an edge 310*c*, 320*c* of the first or second tongues 310, 320. Thickness, $t_{ge}$, is the distance between an unbeveled region of the first surface 310*a* of the first tongue 310 and unbeveled region of the second surface 320*b* of the second tongue 320. In some embodiments, $t_{gbe}$ may be equal to $t_{ge}$, providing a gap that is uniform along the mating y axis. In some embodiments, the gap 330 may be tapered toward the base extension 302, wherein $t_{ge}>t_{gbe}$ and the thickness of the gap 330 decreases linearly from $t_{ge}$ to $t_{gbe}$. In some embodiments, the gap 330 may be tapered toward the edge, wherein $t_{gbe}>t_{ge}$ and the thickness of the gap 330 decreases linearly from $t_{gbe}$ to $t_{ge}$.

Figure 3B:
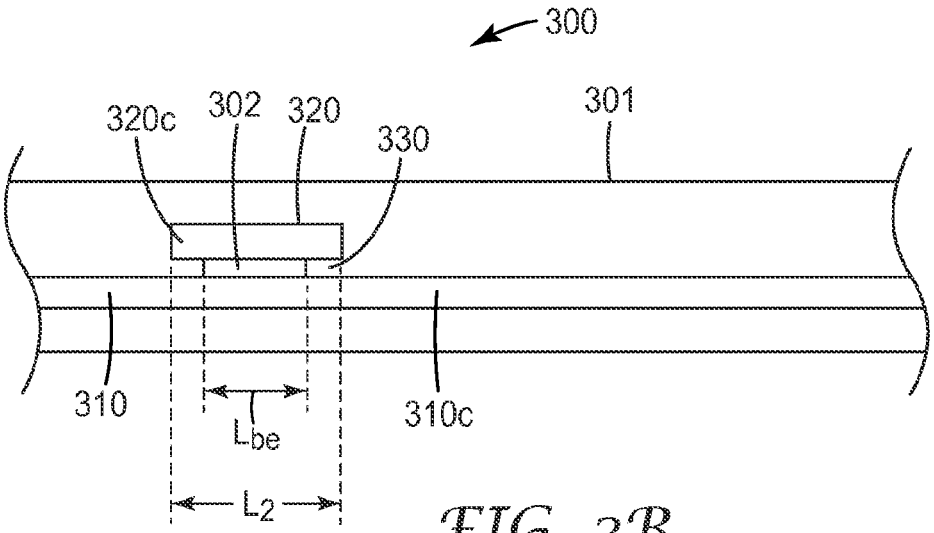
FIG. 3B is a schematic front view showing a portion of connector of FIG. 3A looking through the gap from the tongue edges towards the base.

FIG. 3B is a schematic front view showing a portion of connector 300 looking through the gap 330 from the edges 320*c*, 330*c* towards the base 301. FIG. 3B shows a portion of the first tongue 310 and the second tongue 320 and the gap 330 between the first and second tongues 310, 320. The base extension 302 extends from the base 301 towards the front edges 310*c*, 320*c*. The base extension 302 has a length, $L_{be}$, that in many cases is the same as the length, $L_2$, of the second tongue 320. In some embodiments, such as the illustrated embodiment of FIG. 3B, the length of the base extension, $L_{be}$, is less than the length, $L_2$, of the second tongue. It is also possible for $L_{be}$ to be larger than $L_2$.

Figure 4A:
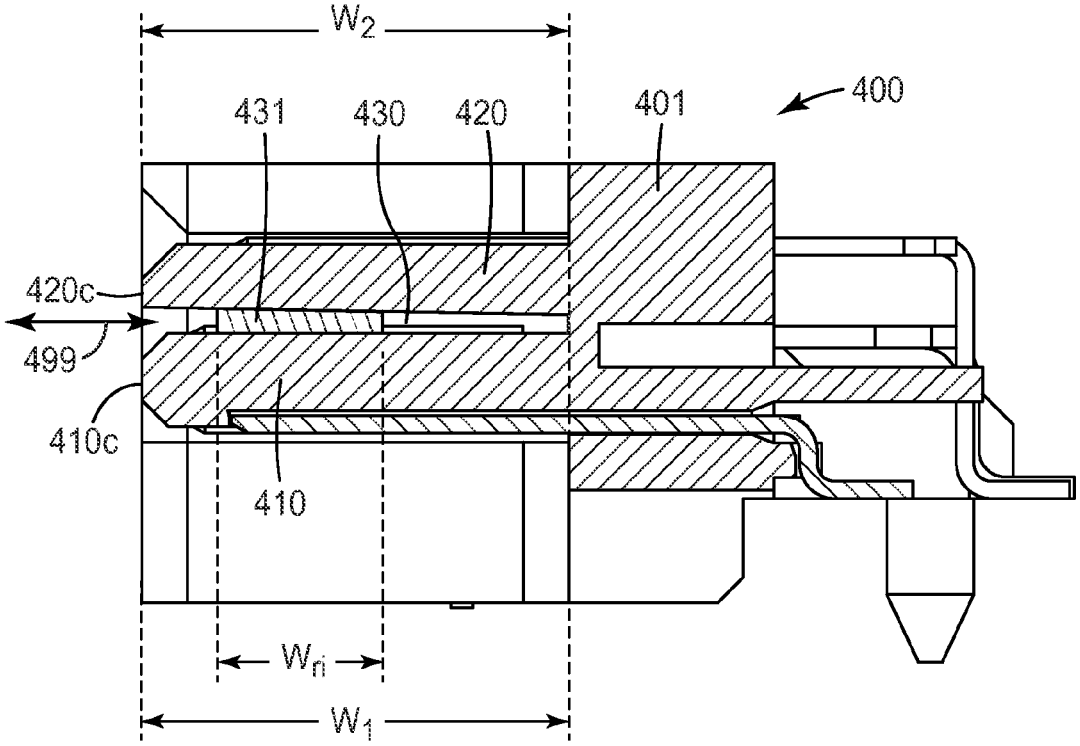
FIG. 4A a side-cross-sectional view of a connector that includes a removable insert in the region of the gap.

FIG. 4A illustrates a connector 400 that is similar in some respects to connector 100. Connector 400 includes a removable insert 431 in the region of the gap 430. The removable insert 431 may be made of plastic or other material and can have structural characteristics capable of providing additional load support to the first and/or second tongues 410, 420. The removable insert 431 has a width, $W_{ri}$, that can be equal to or less than the width, $W_1$, of the first tongue 410, and/or equal to or less than the width, $W_2$, of the second tongue 420. For example, the width, $W_{ri}$, of the removable insert 431 may be about 50% or less than the width, $W_1$, of the first tongue 410 and/or may be about 50% or less than the width, $W_2$, of the second tongue 420.

The removable insert 431 may be placed at any location in the gap 430 along the x and y-axes. For example, the removable insert 431 can be placed proximate to the base 401, at a location within the gap that is substantially centered along the mating y axis, or at a location proximate to the front edges 410*c*, 420*c*. Arrow 499 indicates that the removable insert 431 can be inserted and removed from the gap 430, e.g., from the front of connector 400. In some implementations, the removable insert is removed before the connector 400 mates with a mating connector.

Figure 4B:
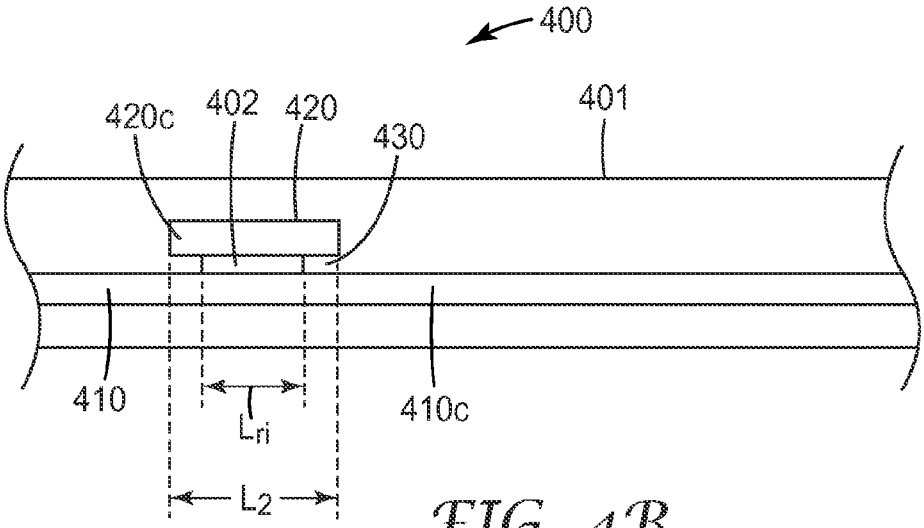
FIG. 4B is a schematic front view showing a portion of connector of FIG. 4A looking through the gap from the tongue edges towards the base.

FIG. 4B is a schematic front view showing a portion of connector 400 looking through the gap 430 from the edges 420*c*, 430*c* towards the base 401. FIG. 4B shows a portion of the first tongue 410, and shows the second tongue 420 with the gap 430 between the first and second tongues 410, 420. The removable insert 431 is shown disposed within the gap 430. The removable insert 431 has a length, $L_{ri}$, that in many cases is the same as the length, $L_2$, of the second tongue 420. In some embodiments, such as the illustrated embodiment of FIG. 4B, the length, $L_{ri}$, of the removable insert 431 is less than the length, $L_2$, of the second tongue 420. It is also possible for $L_{ri}$ to be larger than $L_2$.

Figure 5:
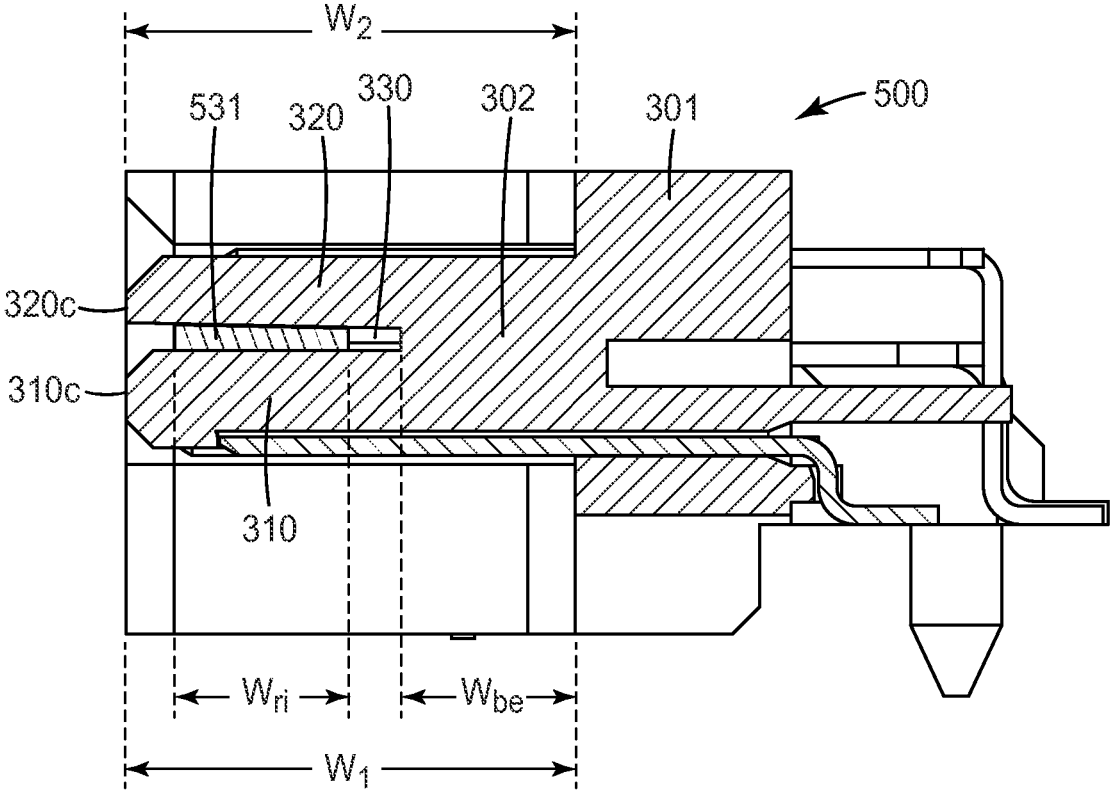
FIG. 5 is a side-cross sectional view a connector that includes a base extension used in conjunction with a removable insert.

Connector 500 shown in FIG. 5 is similar in many respects to connector 300. Connector 500 shows that a base extension 302 may be used in conjunction with a removable insert 531 in some embodiments.

Figure 6C:
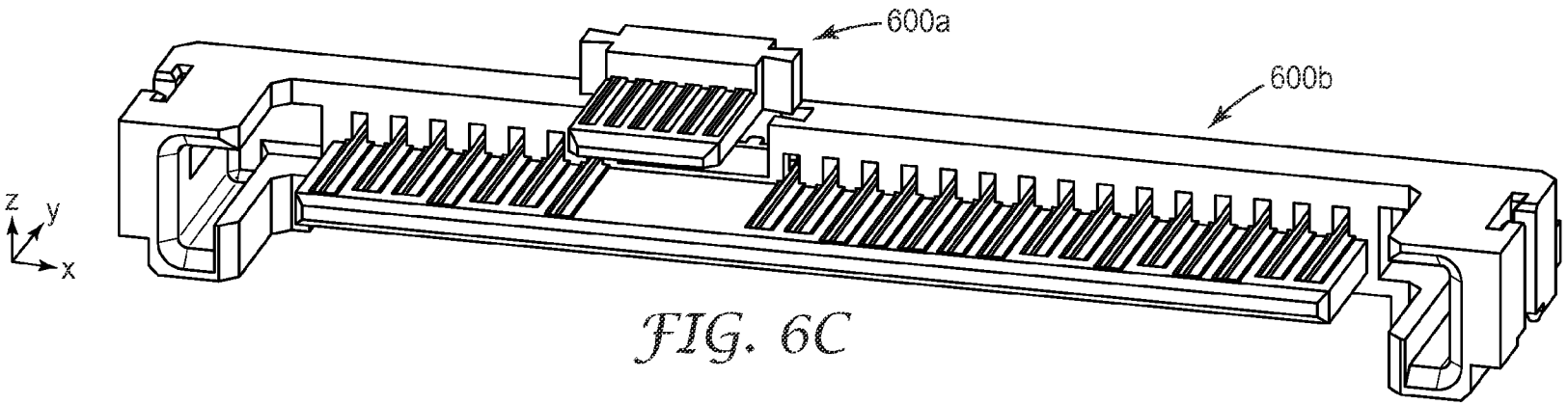

FIGS. 6A-6D illustrate a multi-piece connector in accordance with some embodiments. FIGS. 6A and 6B show first and second connector pieces 600*a*, 600*b*, respectively, of a connector that can be assembled so that the assembled connector (600, FIG. 6D) has a first tongue 610 and a second tongue 620 with a gap 630 disposed therebetween. In this embodiment, the second connector piece 600*b* is reversibly attachable to and removable from the first connector piece 600*a*. The first connector piece 600*a* includes mating features that are configured to mate with compatible mating features of the second connector piece 600*b*, e.g., by snap-fit, friction-fit, or other mechanism.

As depicted in FIGS. 6A-6D, the first connector piece 600*a* includes a base 601 that is elongated along a longitudinal direction (the x-direction as indicated in FIG. 6A) that is perpendicular to a mating direction (the y-direction as indicated in FIG. 6A). The first connector piece 600*a* can include end walls 661, 662 that extend forwardly along the mating y axis from opposite longitudinal ends of the base 601.

In this embodiment, the base 601 includes mating features comprising a slot 602 configured to engage with mating features of the second connector piece 600*b*. Channels 602*a* may be disposed on opposing sides of the slot 602 in the base 601. The channels 602*a* are configured to mate with compatible protrusions 603*b* of the second piece 600*b*. In at least one configuration, the channels 602*a* and compatible protrusions 603*b* may have a dovetail shape.

The second connector piece 600*b*, is sometimes referred to as a sliding portion because, in some embodiments, the second piece 600*b* is slidably attachable to the first connector piece 600*a*. The second connector piece 600*b* includes a tab 603 dimensioned to fit at least partially within the slot 602. Protrusions 603*b* extend on either side of the tab 603 along the longitudinal x-axis. The protrusions 603*b* of the second connector piece 600*b* can be configured to slidably engage with the channels 603*a* of the first connector piece 600*a*.

Figure 6D:
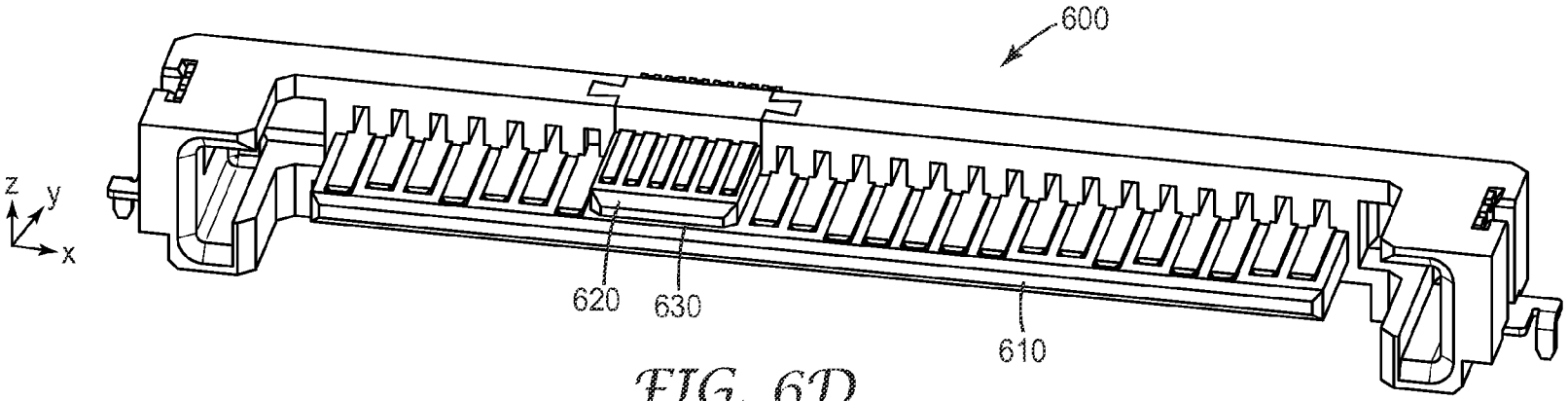

FIG. 6C illustrates the first and second connector pieces, 600*a*, 600*b* during the assembly process. FIG. 6C shows the first and second connector pieces 600*a*, 600*b* aligned for assembly before the channels 602*a* have completely engaged the protrusions 603*b*. FIG. 6D shows the assembled connector 600 after the channels 602*a* are completely engaged with the protrusions 603*b*. The assembled connector 600 shown in FIG. 6D includes a first tongue 610 and a second tongue 620 with a gap 630 between the first and second tongues 610, 620. After assembly, connector 600 can have electrical contacts and other features similar to the configuration of connector 100, for example.

In some embodiments, the first connector piece or the second connector piece may include a base extension, so that the assembled connector has a configuration similar to the configuration of connector 300. In yet other embodiments, a removable insert may be placed between the first and second tongues before the second piece is assembled to the first piece. In this embodiment, the assembled connector has a configuration similar to the configuration of connector 400.

Figure 7A:
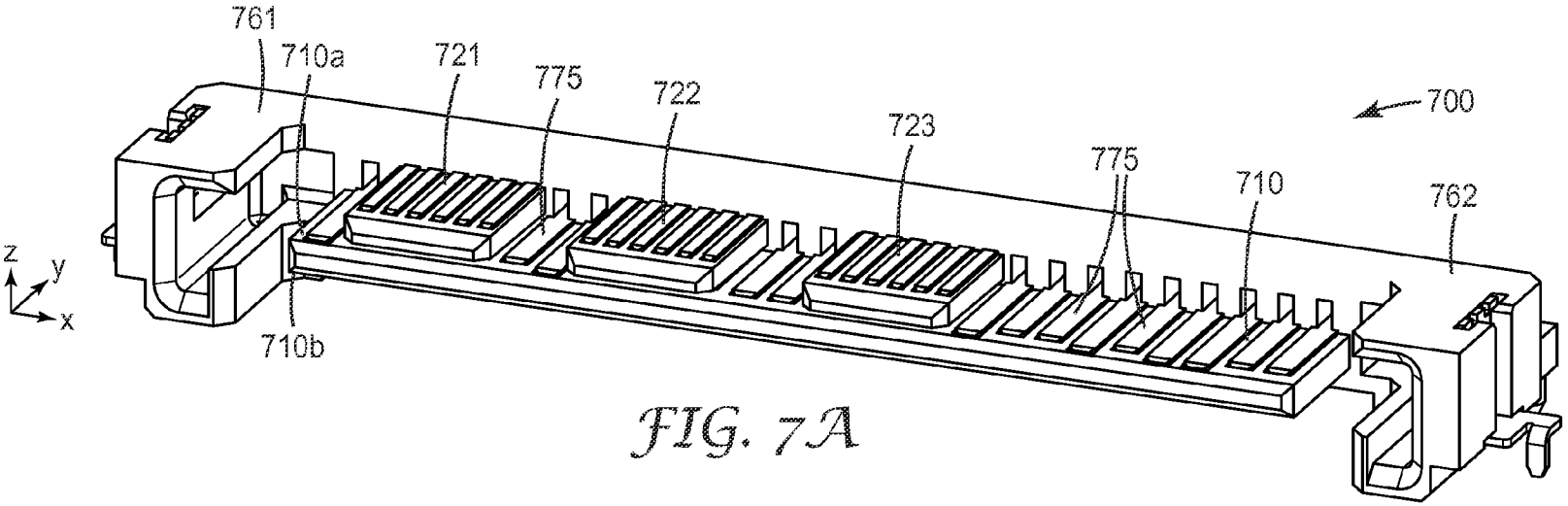
FIGS. 7A-7C are perspective, front, and top views, respectively, of a connector that includes multiple second tongues in accordance with some embodiments.
Figure 7B:
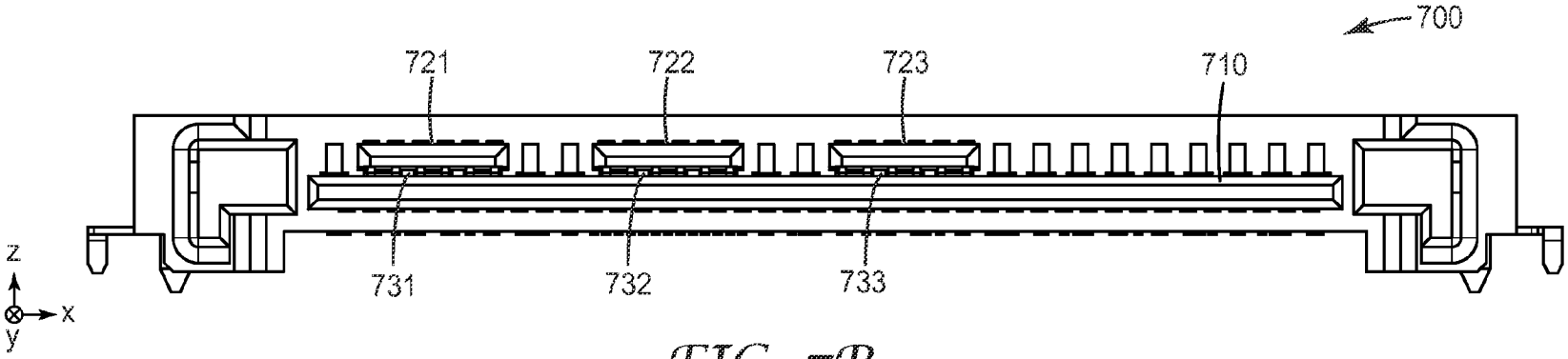
Figure 7C:
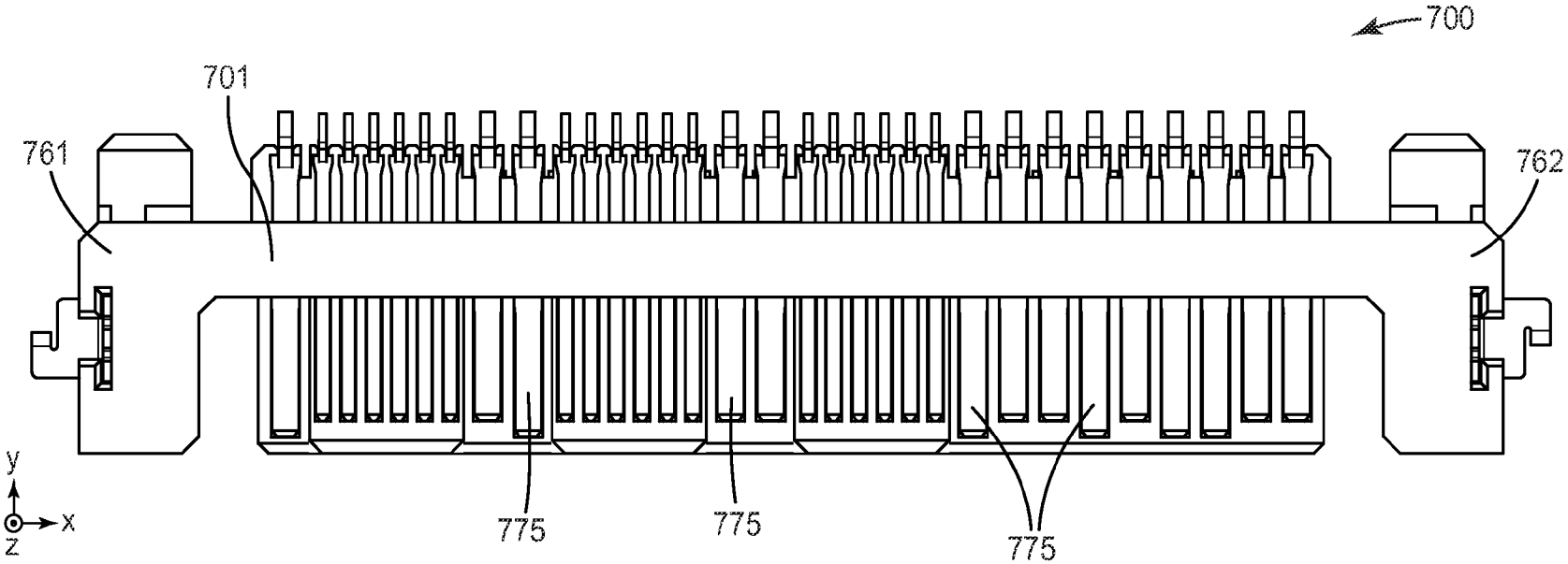

Some embodiments involve connectors that include multiple second tongues, as shown in FIGS. 7A-7C. FIGS. 7A, 7B, and 7C, show a perspective view, a front view, and a top view, respectively, of a connector 700 that includes a first tongue 710 and three second tongues 721, 722, 723. The connector 700 includes a base 701 that is elongated along a longitudinal x-axis. End walls 761, 762 extend forwardly along the mating y-axis from opposite longitudinal ends of the base 701. In some embodiments, the base 701 comprises a unitary, one-piece construction. In some embodiments the base 701 and the end walls 761, 762 are formed as a unitary, one-piece construction.

The connector 700 includes a first tongue 710 and a second tongues 721, 722, 723. Each of the tongues 710, 721, 722, 723 extends from the base 701 forwardly along the mating y-axis. In some embodiments, the base 701, the first and second tongues 710, 721, 722, 723, and the first and second end walls 761, 762 form a unitary construction.

The first tongue 710 is disposed between the end walls 761, 762 and may be spaced apart from the end walls 761, 762. The first tongue 710 has a first surface 710*a* and a second surface 710*b*, and may have a plurality of electrical contacts 775 spaced apart and disposed on the first surface 710*a*. The first tongue 710 may have a plurality of electrical contacts disposed on the second surface 710*b*.

The connector 700 includes a multiple second tongues 721, 722, 723 that extend from the base 701 forwardly along the mating y-axis. The second tongues 721, 722, 723 are disposed between the first and second end walls 761, 762 and may be spaced apart from the end walls 761, 762. The second tongues 721, 722, 723 have first surfaces 721*a*, 722*a*, 723*a* and second surfaces 721*b*, 722*b*, 723*b*. A plurality of electrical contacts 771, 772, 773 may be spaced apart and disposed on the first surfaces 721*a*, 722*a*, 723*a* of the tongues 721, 722, 723. The first surface 710*a* of the first tongue 710 and the second surfaces 721*b*, 722*b*, 723*b* of the second tongue 721, 722, 723 are separated by gaps 731, 732, 733.

In many cases, as shown in FIGS. 7A-7D, there are no electrical contacts on the second surface of the second tongue and there are also no electrical contacts on the first surface of the first tongue in the regions of the gaps 731, 732, 733 where the second tongues 721, 722, 723 overlap the first tongue 710.

In some embodiments, one or more of the second tongues 721, 722, 723 may be disposed on a second connector piece that is reversibly attachable to and removable from a first connector piece that includes the first tongue 710, as previously discussed for a single second tongue in connection with FIGS. 6A-6D. In these embodiments, the connector can be adaptable to achieve a variety of second tongue configurations depending on application.

Figure 8:
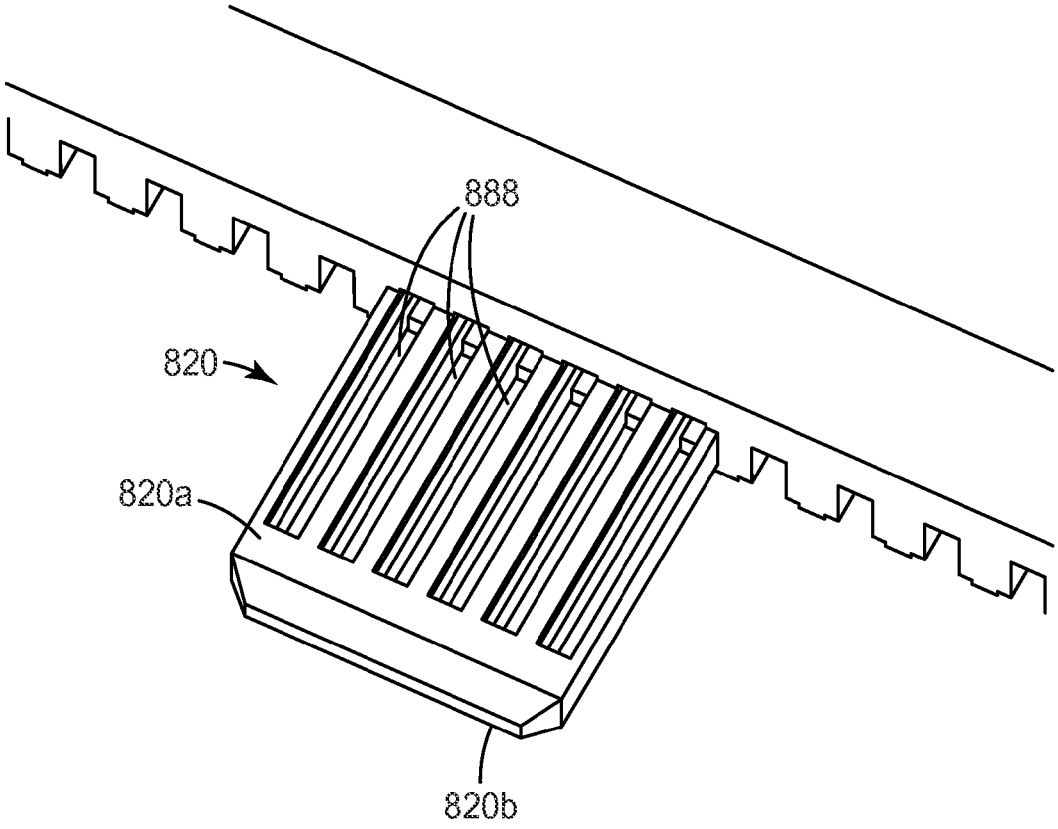
FIG. 8 is a perspective view a portion of a second tongue including through slots that enhance signal integrity (SI) performance of the connector.

FIG. 8 illustrates a portion of a second tongue 820 configured to facilitate impedance matching and to enhance signal integrity (SI) performance of the connector. FIG. 8 shows a top perspective view of a second tongue 820 without electrical contacts. In this view, the second tongue 820 includes through slots 888 spaced apart along the second tongue 820. The through slots 888 extend from the first surface 820*a* of the second tongue through the second surface 820*b* of the second tongue 820. The through slots 888 form air gaps under the electrical contacts after the electrical contacts are installed on the second tongue 820. The air gaps enhance impedance matching and signal integrity (SI) performance of the connector.

Figure 9A:
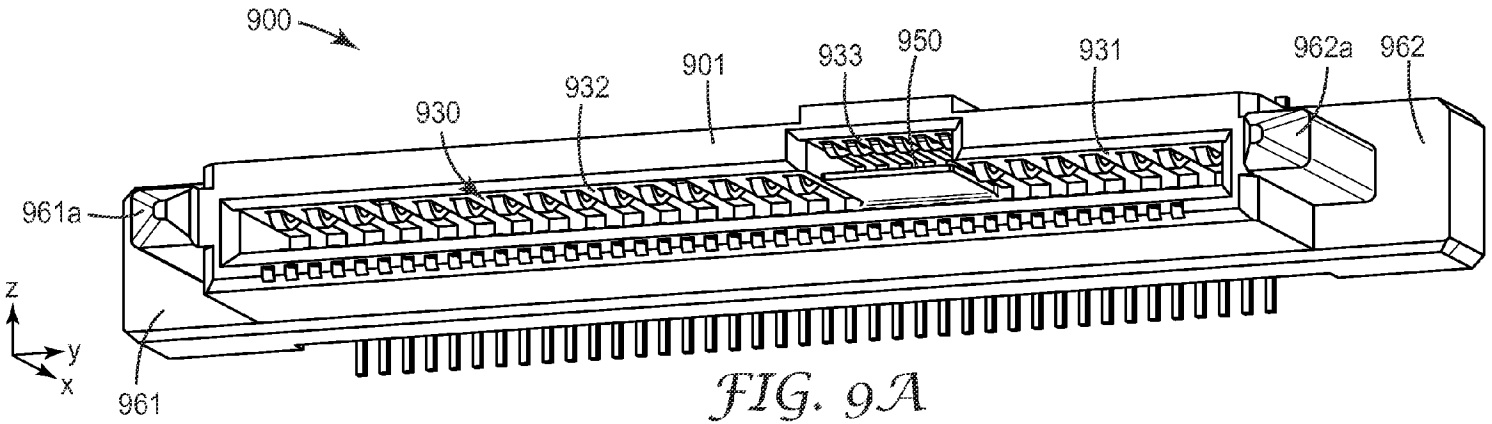
FIG. 9A shows a perspective view of a mating socket connector in accordance with some embodiments.
Figure 9B:
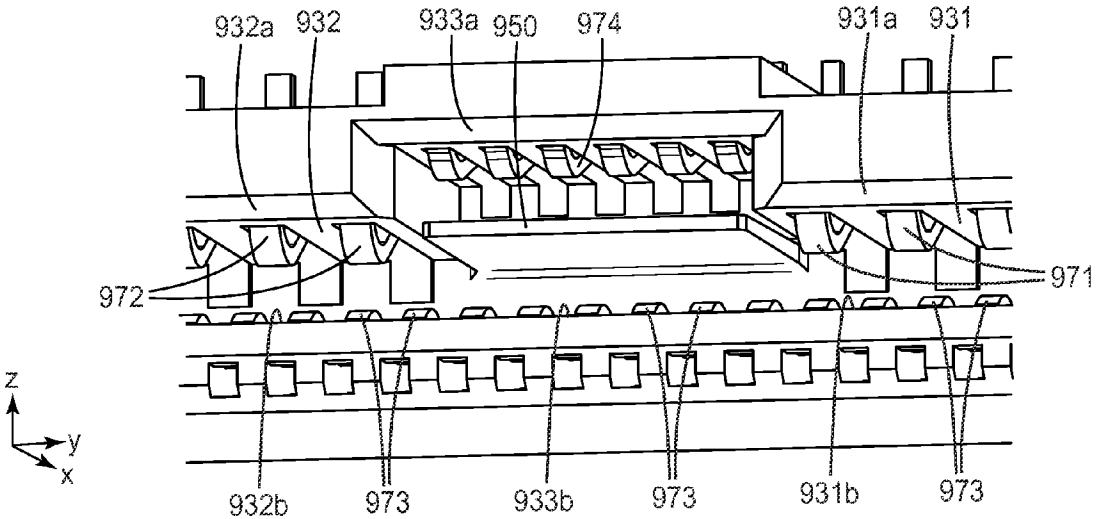
FIG. 9B shows a close-up perspective view of a portion of the connector of FIG. 9A.
Figure 9C:
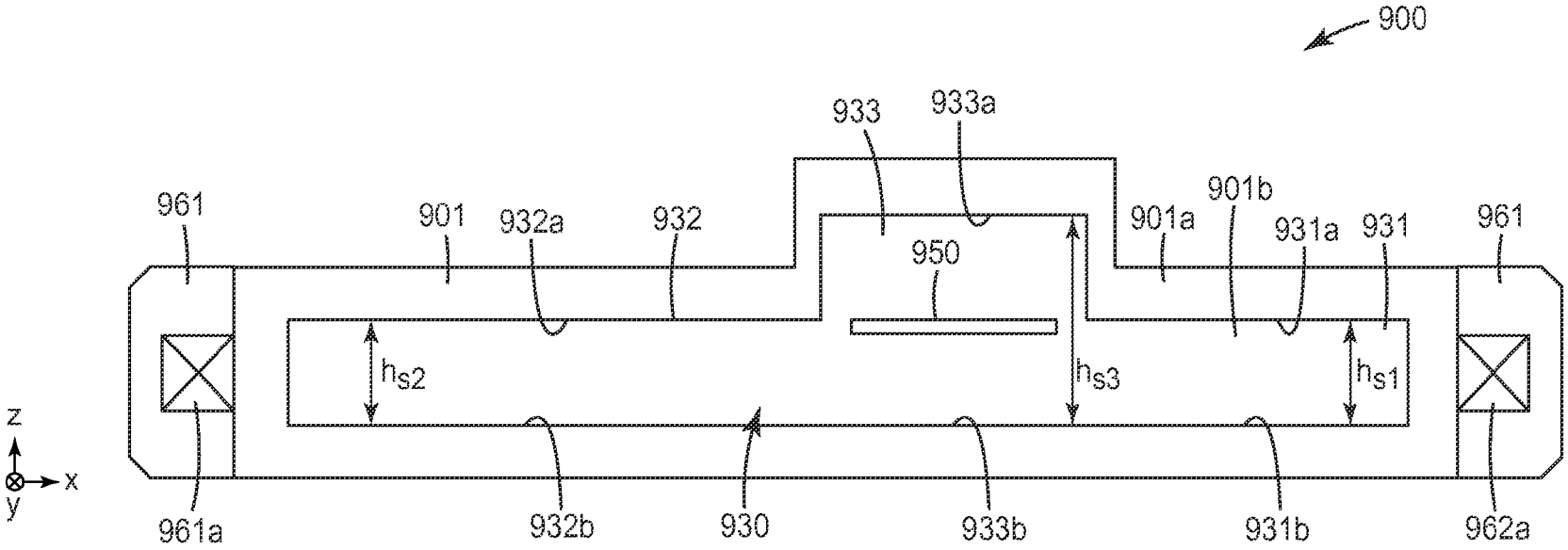
FIG. 9C shows a schematic depiction of a front view of the connector of FIG. 9A.

Some embodiments are directed to mating socket connectors configured to mate to the plug connectors described, for example, in connection with FIGS. 1-8. FIG. 9A shows a perspective view of a mating socket connector 900 in accordance with some embodiments and FIG. 9B shows a close-up perspective view of a portion of connector 900. FIG. 9C shows a schematic depiction of a front view of the connector 900. The connector 900 includes a housing 901 that is elongated along a longitudinal direction (the x-direction in FIGS. 9A-9C) perpendicular to a mating direction (the y-direction in FIGS. 9A-9C) of the connector 900. In some embodiments, the housing may be a multi-piece housing. In some embodiments, the housing, including the blade 950, may be formed as a unitary housing. Whether unitary or multi-piece, the housing 901 can be made of an insulative material such as plastic. The housing 901 comprises a central slot 930 extending along the longitudinal x direction. The central slot 930 includes a first slot portion 931 and second slot portion 932 separated by a third slot portion 933.

Each slot portion 931, 932, 933 includes opposing top and bottom surfaces. As best seen in FIG. 9C, the first slot portion 931 includes opposing top and bottom surfaces 931*a*, 931*b*; the second slot portion 932 includes opposing top and bottom surfaces 932*a*, 932*b*; and the third slot portion 933 includes opposing top and bottom surfaces 933*a*, 933*b*. A separation between the top of bottom surfaces of each slot portion along a thickness direction (z-direction in FIGS. 9A-9C) orthogonal to the longitudinal and mating directions defines a height of the slot 930. The first slot portion 931 has a height, $h_{s1}$; the second slot portion 932 has a height, $h_{s2}$; and the third slot portion 933 has a height, $h_{s3}$. In some embodiments $h_{s1}=h_{s2}$ and $h_{s1}$ and $h_{s2}$ are less than $h_{s3}$. In some implementations, one or more of the heights $h_{s1}$, $h_{s2}$, $h_{s3}$, are uniform along the mating y axis. In some embodiments one or more of the heights $h_{s1}$, $h_{s2}$, $h_{s3}$ may vary along the mating y axis between the mating surface 901*a* and the back surface 901*b*.

The housing 901 comprises a blade 950 that extends forwardly along the mating y-axis from a back surface 901*b* of the third slot portion 933. The blade 950 may have a planar configuration and is disposed between and spaced apart from the top and bottom surfaces 933*a*, 933*b* of the third slot portion 933. The blade 950 may not extend into the first and second slot portions 931, 932. In some embodiments, the blade 950 can be made of insulative material. In some embodiments, the blade 950 does not carry any contacts.

In some embodiments, the bottom surfaces 931*b*, 932*b*, 933*b* of the first, second and third slot portions 931, 932, 933 lie in the same plane. In some embodiments, the top surfaces 931*a*, 932*a* of the first and second slot portions 931, 932 lie in the same plane and the top surface 933*a* of the third slot portion 933 lies in a different plane from the top surfaces 931*a*, 932*a* of the first and second slot portions 931, 932, e.g., a plane that is higher along the z-direction as depicted in FIG. 9A.

As best seen in FIGS. 9A and 9B, the connector 900 includes a plurality of spaced apart electrical contacts including a plurality of first contacts 971 disposed on a top surface 931*a* of the first slot portion 931; a plurality of spaced apart second contacts 972 disposed on a top surface 932*a* of the second slot portion 932; a plurality of spaced apart third contacts 973 disposed on bottom surfaces 931*b*, 932*b*, 933*b* of the first, second and third slot portions 931, 932, 933; and a plurality of spaced apart fourth contacts 974 disposed on a top surface 933*a* of the third slot portion 933.

The electrical connector 900 shown in FIGS. 9A-9C is configured to mate with a mating connector having spaced apart top and bottom tongues defining a gap therebetween, as illustrated, for example, by FIGS. 1-8. The first and second slot portions 931, 932 mate with the first (bottom) tongue, the third slot portion 933 mates with the second (top) tongue, and the blade 950 is inserted in the gap. The blade 950 provides support to at least one of the top and bottom tongues.

In some embodiments, the housing 901 includes end tabs 961, 962 that extend along the longitudinal x-axis. The tabs 961, 962 can include protrusions 961*a*, 962*a* that extend forwardly along the mating y-axis and are configured to slidably engage with the U-shaped channels disposed in the end walls of a mating connector.

Figure 10A:
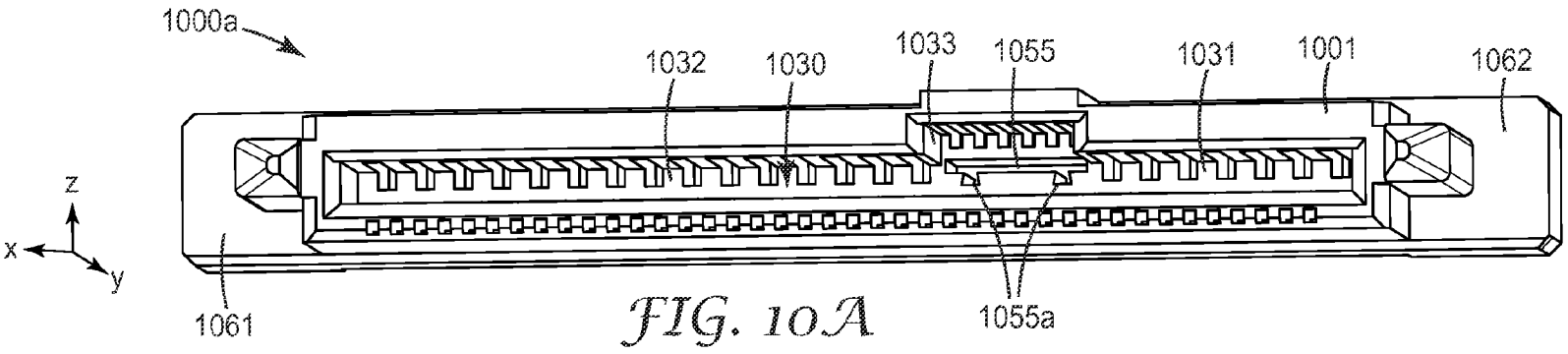
FIGS. 10A-10C are perspective views of a multi-piece socket connector in accordance with some embodiments.
Figure 10B:
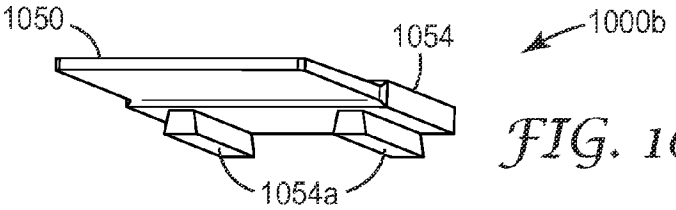
Figure 10C:
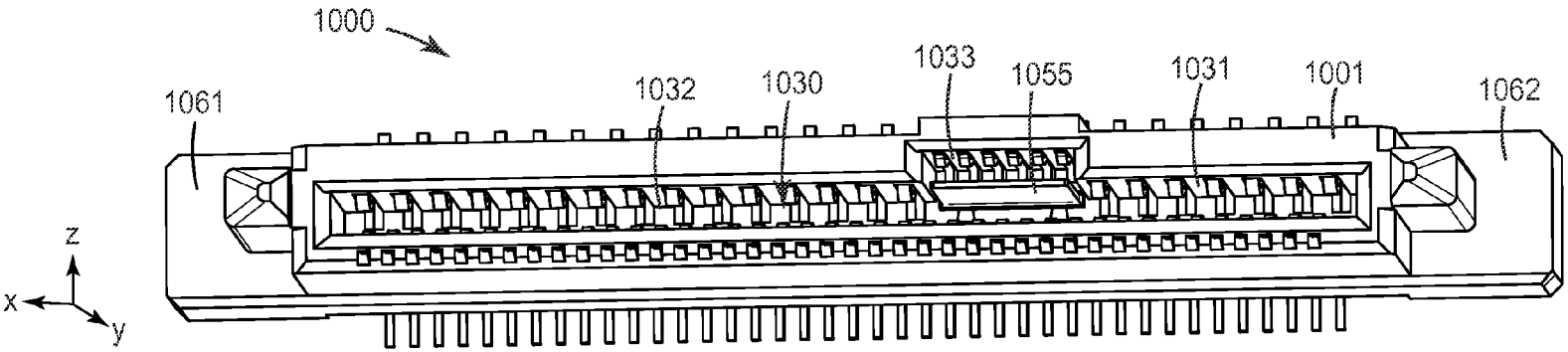

FIGS. 10A-10C illustrate a multi-piece socket connector in accordance with some embodiments. FIGS. 10A and 10B shows first and second connector pieces 1000*a*, 1000*b*, respectively, of a socket connector that can be assembled to form connector 1000 shown in FIG. 10C. In this embodiment, the second connector piece 1000*b* is reversibly attachable to and removable from the first connector piece 1000*a*. The first connector piece 1000*a* includes mating features that are configured to mate with compatible mating features of the second connector piece 1000*b*, e.g., by snap-fit, friction-fit, or other mechanism.

As depicted in FIGS. 10A-10C, the first connector piece 1000*a* includes a housing 1001 that is elongated along a longitudinal direction (the x-direction as indicated in FIG. 10A) and that is perpendicular to a mating direction (the y-direction as indicated in FIG. 10A). The first connector piece 1000*a* can include end tabs 1061, 1062 that extend longitudinally along the longitudinal x-axis at opposite longitudinal ends of the housing 1001.

The housing 1001 comprises a central slot 1030 extending along the longitudinal direction. The central slot 1030 comprises a first slot portion 1031 and second slot portion 1032 separated by a third slot portion 1033. As shown in FIG. 10A, the first connector piece 1000*a* includes an opening 1055 (or slot) in the back surface 1001*b* of the housing 1001 in the third slot portion 1033. The opening 1055 is dimensioned to accept the second connector piece 1000*b*. The opening 1055 can include channels 1055*a* configured to mate with compatible protrusions 1054*a* of the second connector piece 1000*b*. In at least one aspect, the channels 1055*a* and compatible protrusions 1054*a* may have a dovetail shape.

The second connector piece 1000*b* shown in FIG. 10B is dimensioned to be slidably attachable to the first connector piece 1000*a*. The second connector piece 1000*b* includes a tab portion 1054 and a blade 1050. The tab portion 1054 is dimensioned to fit within the opening 1055 of the first connector piece 1000*a*. In some configurations, the edges of the tab portion 1054 are configured to engage the side walls of the opening 1055. In some configurations, one or more protrusions 1054*a* extend from a bottom surface of the tab portion 1054 along the z axis as shown in FIG. 10B. The protrusions 1054*a* are dimensioned to slidably engage with the channels 1055*a*. When the tab portion 1054 is inserted in the opening 1055, the blade 1050 extends forwardly along the mating y-axis in the third slot portion 1033 of the assembled connector 1000.

FIG. 10C shows the assembled connector 1000 after the channels 1055*a* are engaged with the protrusions 1054*a*. The assembled connector 1000 shown in FIG. 10C can have electrical contacts and other features similar to the configuration of connector 900, for example.

Figure 11:
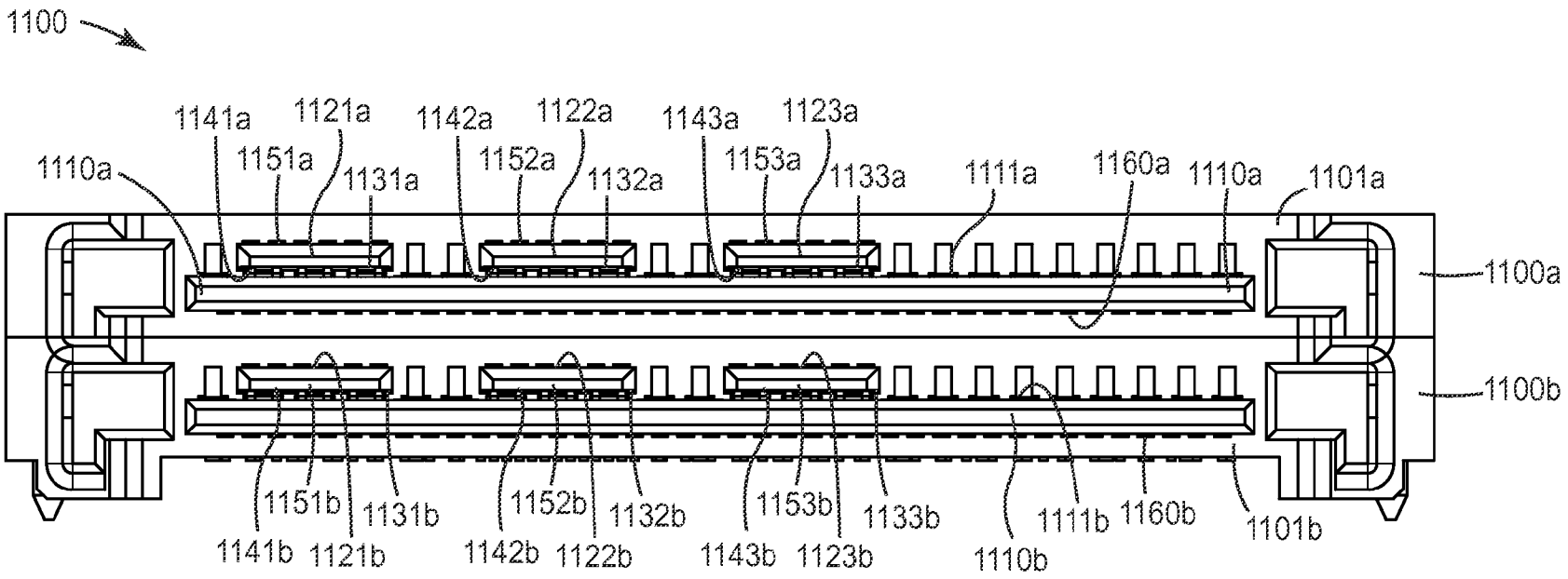
FIG. 11 is a front view of a stacked plug connector in accordance with some embodiments.

In some embodiments, the plug or socket connectors as described herein can be stacked to form stacked plug connectors or stacked socket connectors. FIG. 11 provides an illustration of a stacked plug connector 1100 including a first connector section 1100*a* and a second connector section 1100*b*. Each connector section 1100*a*, 1100*b* includes an elongated housing 1101*a*, 1101*b* from which a first (bottom) tongue and one or more second (top) tongues extend forwardly along the mating direction. In this embodiment, each connector section 1100*a*, 1100*b* includes a first tongue 1110*a*, 1110*b* and three second tongues 1121*a*, 1122*a*, 1123*a*, 1121*b*, 1122*b*, 1123*b*, although in other configurations the connector sections can include one second tongue, two second tongues, or more than three second tongues. The gaps 1131*a*, 1132*a*, 1133*a*, 1131*b*, 1132*b*, 1133*b* between the top surface 1111*a*, 1111*b* of the first tongue 1110*a*, 1110*b* and the bottom surfaces 1141*a*, 1142*a*, 1143*a*, 1141*b*, 1142*b*, 1143*b* of the second tongues 1121*a*, 1122*a*, 1123*a*, 1121*b*, 1122*b*, 1123*b* of the first and/or second connector sections 1100*a*, 1100*b* may be in a range of about 0.1 mm to about 5 mm. The distance between the bottom surface 1160*a* of the first tongue 1110*a* of the first connector section 1100*a* and the top surfaces 1151*b*, 1152*b*, 1153*b* of the second tongues 1121*b*, 1122*b*, 1123*b* of the second connector section 1100*b* are separated by about 1.66 mm.

The first and second connector sections 1100*a*, 1100*b* include electrical contacts arranged on the first and second tongues as previously discussed. For example, for the first connector section 1100*a*, electrical contacts may be arranged on the top and bottom surfaces 1111*a*, 1160*a* of the first tongue 1110*a* and on the top surface 1151*a*, 1152*a*, 1153*a* of the second tongues 1121*a*, 1122*a*, 1123*a*. There may be no electrical contacts on the bottom surfaces 1141*a*, 1142*a*, 1143*a* of the second tongues 1121*a*, 1122*a*, 1123*a* and no electrical contacts on the top surface 1111*a* of the first tongue 1110*a* in the regions of the gaps 1131*a*, 1132*a*, 1133*a* where the second tongues 1121*a*, 1122*a*, 1123*a* overlap the first tongue 1110*a*.

Similarly, for the second connector section 1100*b*, electrical contacts may be arranged on the top and bottom surfaces 1111*b*, 1160*b* of the first tongue 1110*b* and on the top surface 1151*b*, 1152*b*, 1153*b* of the second tongues 1121*b*, 1122*b*, 1123*b*. There may be no electrical contacts on the bottom surfaces 1141*b*, 1142*b*, 1143*b* of the second tongues 1121*b*, 1122*b*, 1123*b* and no electrical contacts on the top surface 1111*b* of the first tongue 1110*b* in the regions of the gaps 1131*b*, 1132*b*, 1133*b* where the second tongues 1121*b*, 1122*b*, 1123*b* overlap the first tongue 1110*b*.

Embodiments disclosed herein include:

Item 1. An elongated electrical connector for mounting on a printed circuit board and mating with a mating connector along a mating direction, the connector includes:

an elongated base extending along a longitudinal direction perpendicular to the mating direction;

first and second end walls extending forwardly along the mating direction from opposite longitudinal ends of the base;

a bottom tongue extending forwardly along the mating direction from the base and disposed between and spaced apart from the first and second end walls, the bottom tongue having a uniform thickness along its length along the longitudinal direction and including first and second bottom tongue portions separated by a third bottom tongue portion;

a top tongue extending forwardly along the mating direction from the base and disposed between and spaced apart from the first and second end walls, the top tongue having a uniform thickness along its length along the longitudinal direction and being spaced apart from the bottom tongue along a thickness direction perpendicular to the mating and longitudinal directions, a bottom surface of the top tongue facing a top face of the third bottom tongue portion;

a plurality of spaced apart first contacts disposed on a top surface of the first bottom tongue portion;

a plurality of spaced apart second contacts disposed on a top surface of the second bottom tongue portion;

a plurality of spaced apart third contacts disposed on a bottom surface of the bottom tongue; and a plurality of spaced apart fourth contacts disposed on a top surface of the top tongue.

Item 2. The elongated electrical connector of item 1, wherein the top and bottom tongues have the same thickness.

Item 3. The elongated electrical connector of item 1, wherein the top tongue is thicker than the bottom tongue.

Item 4. The elongated electrical connector of item 1, wherein the top tongue is thinner than the bottom tongue.

Item 5. The elongated electrical connector of any of items 1 through 4, wherein a length of the top tongue along the longitudinal direction is smaller than a length of the bottom tongue along the longitudinal direction.

Item 6. The elongated electrical connector of any of items 1 through 5, wherein a separation between the top and bottom tongues along the thickness direction is in a range from 0.1 mm to 5 mm.

Item 7. The elongated electrical connector of any of items 1 through 6, wherein there are no contacts on a bottom surface of the top tongue.

Item 8. The elongated electrical connector of any of items 1 through 7, wherein there are contacts on a bottom, but not top, surface of the third bottom tongue portion.

Item 9. The elongated electrical connector of any of items 1 through 8, wherein the bottom tongue has a width along the mating direction measured from a front edge of the bottom tongue to the base, the first and second bottom tongue portions having a larger width, the third bottom tongue portion having a smaller width.

Item 10. The elongated electrical connector of any of items 1 through 9, wherein the base, the top and bottom tongues, and the first and second end walls form a unitary construction.

Item 11. The elongated electrical connector of any of items 1 through 10, wherein a separation distance between the top and bottom tongues along the thickness direction is variable.

Item 12. The elongated electrical connector of any of items 1 through 11, wherein the top tongue is reversibly attachable to and removable from the connector.

Item 13. The elongated electrical connector of item 12, wherein the base includes a sliding portion, the top tongue extending forwardly along the mating direction from the sliding portion of the base, the base including a groove along the thickness direction, the top tongue being reversibly attachable to and removable from the connector by the sliding portion of the base sliding along the groove.

Item 14. The elongated electrical connector of any of items 1 through 13, wherein the top tongue includes a plurality of spaced apart slots, each slot extending from the top surface to a bottom surface of the top tongue, each contact in the plurality of fourth contacts being disposed on a corresponding slot.

Item 15. The elongated electrical connector of any of items 1 through 14, further including an insert removably inserted in a gap defined between the spaced apart top and bottom tongues, the insert providing support to the top tongue.

Item 16. The elongated electrical connector of item 15, wherein the insert is removed before the connector mates with a mating connector.

Item 17. The elongated electrical connector of any of items 1 through 16, wherein each of the first and second end walls includes a U-shaped channel configured to slidably engage with a mating connector.

Item 18. An electrical connector includes:

a unitary base elongated along a longitudinal direction;

a first tongue extending forwardly from the base and having a uniform thickness along the longitudinal direction, the first tongue including a plurality of spaced apart first contacts;

a second tongue extending forwardly from the base and including a plurality of spaced apart second contacts, the first and second tongues defining a gap therebetween that extends from a front edge of one of the first and second tongues toward the unitary base.

Item 19. The electrical connector of item 18, wherein the gap extends from the front edge of one of the first and second tongues to the unitary base.

Item 20. The electrical connector of any of items 18 through 19, wherein the first tongue has a width measured from a front edge of the first tongue to the unitary base, the width being substantially the same across the length of the first tongue.

Item 21. The electrical connector of any of items 18 through 20, wherein each of the first and second tongues has a length along the longitudinal direction, the length of the first tongue being greater than the length of the second tongue.

Item 22. The electrical connector of any of items 18 through 21, wherein each of the first and second tongues has a length along the longitudinal direction and a width measured from a front edge of the tongue to the base, each of the first and second tongues having a uniform thickness across the width and length of the tongue.

Item 23. The electrical connector of any of items 18 through 22, wherein the first and second tongues define an overlap region between the two tongues, wherein in the overlap region, each tongue includes contacts only on one major surface of the tongue.

Item 24. The electrical connector of any of items 18 through 23, wherein the first and second tongues define an overlap region between the two tongues, wherein in the overlap region, neither tongue includes contacts on a major surface of the tongue that faces the other tongue.

Item 25. The electrical connector of any of items 18 though 24, wherein the first and second tongues define an overlap region between the two tongues, wherein in the overlap region, each tongue includes contacts only on a major surface of the tongue that faces away from the other tongue.

Item 26. An electrical connector includes:

a unitary housing elongated along a longitudinal direction perpendicular to a mating direction of the connector, the unitary housing defining a central slot extending along the longitudinal direction, the central slot including first and second slot portions separated by a third slot portion, each slot portion including opposing top and bottom surfaces, a separation between the top of bottom surfaces of each slot portion along a thickness direction orthogonal to the longitudinal and mating directions defining a height of the slot, the first and second slot portions having a same smaller height, the third slot portion having a greater height, the unitary housing including a blade extending forwardly along the mating direction from a back surface of the third slot portion and disposed between and spaced apart from the top and bottom surfaces of the third slot portion;

a plurality of spaced apart first contacts disposed on a top surface of the first slot portion;

a plurality of spaced apart second contacts disposed on a top surface of the second slot portion;

a plurality of spaced apart third contacts disposed on bottom surfaces of the first, second and third slot portions; and a plurality of spaced apart fourth contacts disposed on a top surface of the third slot portion.

Item 27. The electrical connector of item 26, wherein the bottom surfaces of the first, second and third slot portions lie in a sample plane.

Item 28. The electrical connector of any of items 26 through 27, wherein the top surfaces of the first and second slot portions lie in a same plane and the top surface of the third slot portion lies in a higher plane.

Item 29. The electrical connector of any of items 26 through 28, wherein the blade does not extend into the first and second slot portions.

Item 30. The electrical connector of any of items 26 through 29, wherein when the connector mates with a mating connector having spaced apart top and bottom tongues defining a gap therebetween, the first and second slot portions mate with the bottom tongue, the third slot portion mates with the top tongue, and the blade is inserted in the gap.

Item 31. An electrical connector includes a unitary insulative housing defining an elongated slot bound by opposing first and second major surfaces and including a blade extending from a back surface of the slot toward a front of the slot and disposed between and spaced apart from the first and second major surfaces, a first plurality of contacts disposed on the first major surface and facing the blade, a second plurality of contacts disposed on the second major surface and facing the blade.

Item 32. The electrical connector of item 31, wherein the blade does not carry any contacts.

Item 33. An electrical connector adapted to mate with a mating connector that includes overlapping planar top and bottom tongues defining a gap therebetween with each tongue carrying a plurality of contacts, the electrical connector including an insulative planar blade, such that when the electrical connector mates with the mating connector, the insulative planar blade is inserted in the gap to provide support to at least one of the top and bottom tongues.

Item 34. The electrical connector of item 33, wherein the blade does not carry any contacts.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of this invention will be apparent to those skilled in the art and it should be understood that this scope of this disclosure is not limited to the illustrative embodiments set forth herein. For example, the reader should assume that features of one disclosed embodiment can also be applied to all other disclosed embodiments unless otherwise indicated. It should also be understood that all U.S. patents, patent application publications, and other patent and non-patent documents referred to herein are incorporated by reference, to the extent they do not contradict the foregoing disclosure.

The invention claimed is:

1. An elongated electrical connector for mounting on a printed circuit board and mating with a mating connector along a mating direction, the connector comprising:

an elongated base extending along a longitudinal direction perpendicular to the mating direction;

first and second end walls extending forwardly along the mating direction from opposite longitudinal ends of the base;

a bottom tongue extending forwardly along the mating direction from the base and disposed between and spaced apart from the first and second end walls, the bottom tongue having a uniform thickness along its length along the longitudinal direction and comprising first and second bottom tongue portions separated by a third bottom tongue portion;

a top tongue extending forwardly along the mating direction from the base and disposed between and spaced apart from the first and second end walls, the top tongue having a uniform thickness along its length along the longitudinal direction and being spaced apart from the bottom tongue along a thickness direction perpendicular to the mating and longitudinal directions, a bottom surface of the top tongue facing a top face of the third bottom tongue portion;

a plurality of spaced apart first contacts disposed on a top surface of the first bottom tongue portion;

a plurality of spaced apart second contacts disposed on a top surface of the second bottom tongue portion;

a plurality of spaced apart third contacts disposed on a bottom surface of the bottom tongue; and a plurality of spaced apart fourth contacts disposed on a top surface of the top tongue.

2. The elongated electrical connector of claim 1, wherein the top tongue is reversibly attachable to and removable from the connector.

* * * * *